United States Patent [19]

Neumann et al.

[11] 3,947,226

[45] Mar. 30, 1976

[54] COMBUSTION SYSTEM

[75] Inventors: Ernst-Georg Neumann, Bochum-Querenburg; Giesbert Tewes; Alfons Bader, both of Essen, all of Germany

[73] Assignee: Krupp-Koppers GmbH, Essen, Germany

[22] Filed: Oct. 2, 1974

[21] Appl. No.: 511,257

[30] Foreign Application Priority Data

Oct. 6, 1973 Germany ..... 2350338

[52] U.S. Cl. ..... 431/114

[51] Int. Cl.[2] ..... F23D 15/02

[58] Field of Search ..... 431/114; 55/276

[56] References Cited

UNITED STATES PATENTS

| | | | |
|---|---|---|---|
| 2,410,548 | 11/1946 | McCollum | 431/114 X |
| 3,413,069 | 11/1968 | Walsh | 431/114 X |
| 3,773,075 | 11/1973 | Thompson et al. | 431/114 X |
| 3,840,326 | 10/1974 | Schrter | 431/114 |

*Primary Examiner*—Edward G. Favors

*Attorney, Agent, or Firm*—Michael J. Striker

[57] ABSTRACT

A combustion system, such as a recuperator in a furnace, has a combustion chamber, a burner which communicates with the combustion chamber and tends in operation to produce acoustic waves leading to the development of vibrations, and a conduit communicating with the burner and supplying thereto a stream of fuel fluid. The development of the waves and vibrations is precluded by providing in the conduit upstream of the burner a compartment having a volume equal to forty times the product of the cross-sectional area and the diameter of the conduit so that the acoustical waves originating in the burner are reflected, and the conduit is further intermediate the burner and the compartment so constructed as to be of unobstructed cross-section and has a length equal to substantially one-quarter of the wave length of sound waves which would develop if the vibrations were allowed to occur.

5 Claims, 4 Drawing Figures

COMBUSTION SYSTEM

BACKGROUND OF THE INVENTION

The present invention relates generally to combustion systems, and more particularly to combustion systems having an arrangement for suppressing combustion chamber vibrations.

There are many instances, for example in industrial furnace recuperators, where combustion chamber vibrations of the organ-pipe variety develop when the system is in operation. Such vibrations can lead to damage to the system. Details of the development and the possible damage resulting from such vibrations can be found in A. A. Putnam and W. R. Dennis, "Survey of Organ-Pipe Oscillations in Combustion Systems," Journal of the Acoustic Society of America, 28 (1956). These are self-excited acoustic vibrations in the gas columns in the combustion chamber, in the grate chamber, and in the conduits which supply the fuel liquid and the combustion air to the burner. The self-excitation of such oscillations or vibrations is largely determined by the characteristics of the flame in the burner, the size and form of the combustion chamber and the acoustic impedances of the outlets of the fuel fluid and combustion air conduits into the combustion chamber. Details of the determination and calculation of the acoustical impedance may be found in E. Meyer and E. G. Neumann, "Physikalische und Technische Akustik", Friedrich Wieweg & Sohn, Braunschweig, Germany, 1967.

The development of such oscillations is undesirable, not only because of the noise level involved, but because they can lead to actual damage to the system. It has been found that of the various factors which are involved in the generation of such oscillations, the acoustical impedances are most readily susceptible to variation, and thus can be used in an attempt to control the development of the oscillations.

In fact, in a research paper issued by IRSID, namely J. M. Pariel, und L. de Saint Martin, "Contribution a l'Etude' des Instabilites de Combustions dans les Foyers Industriels," Revue Generale de Thermique, Volume VI, No. 69, Sept. 19, 1967, recommendations are made for selecting the length of the conduits between the burner inlet and acoustically reflecting points of the conduit system in such installations, in an attempt to overcome the development of oscillations. Acoustically reflecting points are identified as the change in cross-section between the gas collecting conduit and the feeder line extending from the same to the burner chamber, and the blower for supplying combustion air. The influence of such devices as the damper or throttle in the fuel fluid conduit, which extend into the cross-section of the conduit, is not taken into account in these recommendations. It is intended that when the recommended distances between the burner inlet and the main reflective points are maintained, the acoustic impedances of the conduits are to assume values at the burner inlet which prevent the development of self-excited oscillations.

However, experience and examinations have shown that in actual fact even installations constructed in accordance with these requirements are still subject to self-excited combustion chamber oscillations which, as examination has shown, are the result primarily of the acoustic behavior of components which extend into the cross-section of the fuel fluid feeder conduit intermediate the burner and the variation in the cross-section which occurs where the feeder conduit branches off from the collecting conduit. These devices, such as the throttle which is used to vary the flow of fuel fluid, and a measuring device for measuring the flow of fuel fluid, are absolutely necessary for a proper operation of the system and it is therefore not possible to dispense with them. A further reason which has been found for the development of self-excited oscillations despite the recommendations made in the industry is that these recommendations assume an excessively high impedance range as having a vibration damping characteristic, which is not the case.

SUMMARY OF THE INVENTION

Accordingly, it is an object of the present invention to provide a combustion system wherein the self-excitation of oscillations and vibrations is completely and reliably prevented.

It is another object of the present invention to provide such a combustion system which is simple in construction.

In keeping with these objects, and with others which will become apparent hereafter, one feature of the invention resides in an arrangement wherein the desired impedance in the outlet of the fuel fluid conduit is produced in that the fuel fluid conduit has interposed in it a compartment for the reflection of acoustic waves originating from the burner, this compartment having a volume which is equal to approximately forty times the product of the cross-sectional area and the diameter of the fuel fluid conduit, or is larger than this, and wherein the fuel fluid conduit is of unobstructed cross-section intermediate the compartment and the burner inlet and has a length which is equal to approximately one quarter of the wave length of sound waves which would develop in the fuel fluid if self-excitation were to be permitted to occur.

The novel features which are considered as characteristic for the invention are set forth in particular in the appended claims. The invention itself, however, both as to its construction and its method of operation, together with additonal objects and advantages thereof, will be best understood from the following description of specific embodiments when read in connection with the accompanying drawings.

DESCRIPTION OF THE PREFERRED EMBODIMENTS

Figure 1:
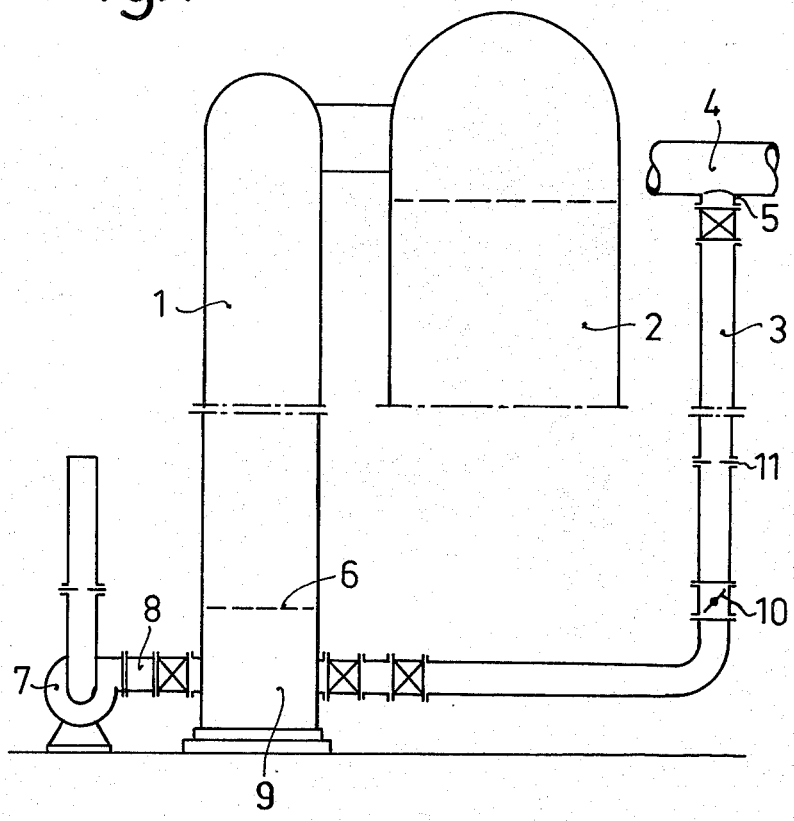
FIG. 1 is a diagrammatic illustration showing the construction of a prior-art recuperating system without the present invention.

Referring firstly to FIG. 1 it will be seen that in that prior-art construction reference numeral 1 identifies the combustion chamber or upright shaft, and reference numeral 2 identifies the grate shaft of the recuperator installation which is used in an industrial furnace. Reference numeral 3 identifies the feeder conduit which branches off from the gas collecting conduit 4 and suplies fuel fluid to a burner 9. At the junction of the feeder conduit 3 and the gas collecting conduit 4 is a cross-sectional step 5. Combustion air is supplied to the burner 9, the inlet of which is identified with reference numeral 6, via a conduit 8 from a blower 7. Reference numeral 10 identifies a throttle or damper by means of which the amount of fuel fluid that can flow to the burner 9 is regulated, and reference numeral 11 identifies a measuring device by means of which the amount of fuel fluid flowing through the conduit 3 per unit time, can be measured.

The system of FIG. 1 is subject to the self-excitation of organ-pipe oscillations, with the consequent damage resulting therefrom.

Figure 2:
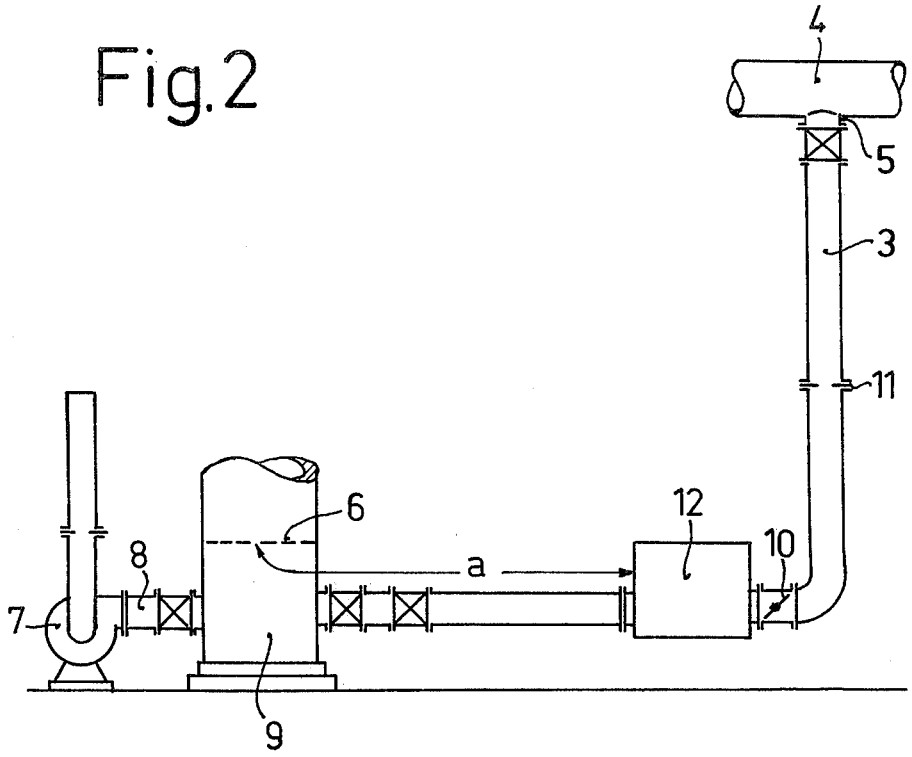
FIG. 2 illustrates the system of FIG. 1, embodying one embodiment of the invention.

FIG. 2 shows a system which is analogous to that of FIG. 1, and wherein like reference numerals identify like elements. In FIG. 2, however, the present invention is embodied in that a compartment 12 is interposed in the conduit 3, being spaced by the distance *a* from the burner inlet 6. The distance *a* corrresponds to approximately one-quarter of the wave-length of sound waves in the gas flowing in the conduit 3 if such sound waves were allowed to develop. The volume of the compartment 12 corresponds to or is greater than approximately forty times the product of the cross-sectional area of the conduit 3 and the diameter thereof. Over the distance *a* the interior cross-section of the conduit 3 is unobstructed, and it will be seen that the throttle 10 and the measuring device 11 are located upstream of the compartment 12, intermediate the same and the gas collecting conduit 4.

Figure 3:
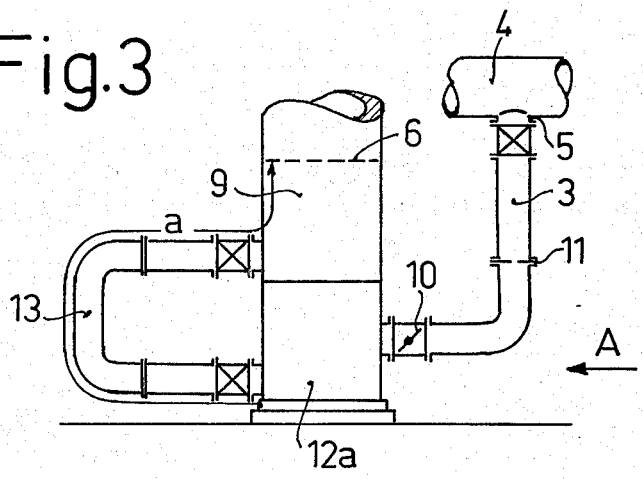
FIG. 3 is a fragmentary detail view, illustrating a further embodiment of the invention.
Figure 4:
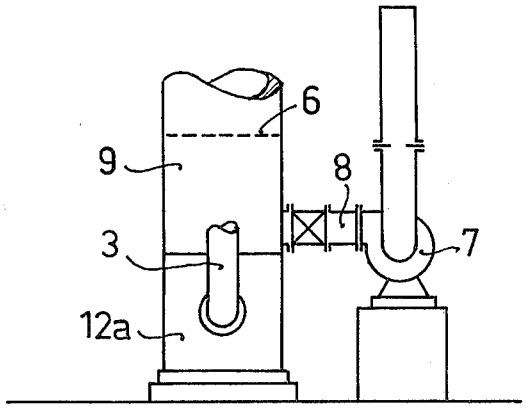
FIG. 4 is a view of FIG. 3, seen in the direction of the arrow A of that Figure.

The embodiment of FIGS. 3 and 4 shows that the compartment 12 can be replaced with a compartment 12*a* which is constructed as a separate compartment in the lowest portion of the upright combustion column 1 of the system. The compartment 12*a* is connected with the burner inlet 6 by the conduit 13 which again has a length *a*. In all other respects the embodiment of FIGS. 3 and 4 corresponds to that of FIG. 2, and its operation and effect will also be the same.

By resorting to the present invention, the impedance of the inlet of the conduit 3 at a predetermined frequency of the vibrations is determined only by the impedance of the gas outlet of the compartment 12 or 12*a*, and the length of the conduit between the compartment and the burner inlet 6, and is independent of such components which tend to reduce the cross-section of the fuel fluid conduit, as the throttle and the measuring device mentioned above. By arranging the throttle and the measuring device in the manner disclosed in FIGS. 1 and 3–4, they no longer have any significant influence on the acoustic characteristics of the outlet end of the compartment 12 or 12*a*, and therefore the development of self-excited oscillations is suppressed.

In principle, the location of the compartment 12 or 12*a* can be freely selected as long as the length *a* of the conduit between the compartment 12 or 12*a* and the burner inlet 6 is maintained equal to approximately one-quarter of the wave length of sound that would develop if vibrations were permitted. The embodiment in FIGS. 3 and 4 is currently preferred because it eliminates the need for additional space to accommodate or provide the compartment 12 as in FIG. 2. Moreover, the embodiment of FIGS. 3 and 4 has the advantage that the length *a* of the conduit can be readily changed in the event that the natural frequencies of the combustion chamber 1 which have been calculated before the installation was built are found to deviate in actual fact from the calculations when the installation is built and operated.

It will be understood that each of the elements described above, or two or more together, may also find a useful application in other types of constructions differing from the types described above.

While the invention has been illustrated and described as embodied in a combustion system, it is not intended to be limited to the details shown, since various modifications and structural changes may be made without departing in any way from the spirit of the present invention.

Withoug further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a combustion system, a combination comprising a combustion chamber; a burner communicating with said combustion chamber and tending in operation to produce vibrations; a conduit communicating with said burner and supplying thereto a stream of fuel fluid; and a compartment interposed in said conduit and having a volume equal to a multiple of the product of the cross-sectional area and the diameter of said conduit for reflexion of acoustical waves originating in said burner and tending to produce said vibrations, that portion of said conduit which connects said burner and said compartment being of unobstructed cross-section and having a length equal to substantialy one quarter of the wave length of said acoustical waves which would develop if vibrations were allowed to occur.

2. A combination as defined in claim 1, wherein said system comprises a furnace recuperator having said combustion chamber in form of an upright shaft, and wherein a lower end portion of said shaft is configurated as said compartment and interposed in said conduit.

3. A combination as defined in claim 2, wherein said lower end portion is separate from the remainder of said upright shaft; and wherein said conduit comprises said portion connecting said burner and said compartment, and a discrete further portion communicating with said compartment and supplying said stream of fuel fluid thereto.

4. A combination as defined in claim 1, wherein said volume of said compartment is equal to about forty times said product.

5. A combination as defined in claim 1; and further comprising a throttle and a measuring instrumentality interposed in said conduit upstream of said compartment.

* * * * *